US005818290A

United States Patent [19]

Tsukada

[11] Patent Number: 5,818,290

[45] **Date of Patent: *Oct. 6, 1998**

[54] BIAS VOLTAGE CONTROLLING APPARATUS WITH COMPLETE FEEDBACK CONTROL

[75] Inventor: Shyuichi Tsukada, Tokyo, Japan

[73] Assignee: NEC Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 601,242

[22] Filed: Feb. 14, 1996

[30] Foreign Application Priority Data

Feb. 15, 1995 [JP] Japan ..... 7-025749

[51] Int. Cl.[6] ..... G05F 1/10

[52] U.S. Cl. ..... 327/537; 327/535

[58] Field of Search ..... 327/534, 535, 327/537

[56] References Cited

U.S. PATENT DOCUMENTS

| | | | |
|---|---|---|---|
| 4,152,595 | 5/1979 | Garfinkel et al. | 327/535 |
| 4,769,784 | 9/1988 | Doluca et al. | 327/537 |
| 4,794,278 | 12/1988 | Vajdic | 327/537 |
| 4,994,689 | 2/1991 | Kikuda et al. | 327/534 |
| 5,243,228 | 9/1993 | Maruyama et al. | 327/534 |
| 5,266,843 | 11/1993 | Walker et al. | 327/535 |
| 5,270,584 | 12/1993 | Koshikawa et al. | 327/534 |
| 5,367,489 | 11/1994 | Park et al. | 327/534 |
| 5,539,351 | 7/1996 | Gilsdorf et al. | 327/535 |

FOREIGN PATENT DOCUMENTS

| | | | |
|---|---|---|---|
| 57-199335 | 12/1982 | Japan | 327/534 |
| A-63-4491 | 1/1988 | Japan . | |

OTHER PUBLICATIONS

T. Kobayashi et al., "Self–Adjusting Threshold–Voltage Scheme (SATS) for Low–Voltage High–Speed Operation", IEEE Custom Integrated Circuits Conf. pp. 271–274, 1994.

*Primary Examiner*—Terry Cunningham

[57] ABSTRACT

In a bias voltage controlling apparatus, a bias voltage comparator circuit compares a bias voltage with a reference voltage. When the bias voltage is higher than the reference voltage, a bias voltage lowering circuit lowers the bias voltage. When the bias voltage is not higher than the reference voltage, a bias voltage lowering circuit raises the bias voltage.

6 Claims, 9 Drawing Sheets

BIAS VOLTAGE CONTROLLING APPARATUS WITH COMPLETE FEEDBACK CONTROL

BACKGROUND OF THE INVENTION

1. Field of the Invention

The present invention relates to a bias voltage controlling apparatus for a substrate bias voltage and a step-up voltage (or bootstrapped voltage).

2. Description of the Related Art

For example, in a semiconductor device such as a dynamic random access memory (DRAM) device, a negative substrate bias voltage is applied to a semiconductor substrate so that a threshold voltage is brought close to an optimum value. That is, the lower the threshold voltage, the larger the sub threshold leakage current. Conversely, the higher the threshold voltage, the larger the junction leakage current. Therefore, when the threshold voltage is deviated from the optimum value, the hold characteristics of memory cells are deteriorated.

A first prior art substrate bias voltage controlling apparatus includes a bias voltage comparator circuit for comparing a bias voltage with a reference voltage, and a bias voltage lowering circuit comprised of a pump circuit for lowering the bias voltage, when the bias voltage is higher than the reference voltage. This will be explained later in detail.

Incidentally, in the DRAM device, in order to reduce the power dissipation during a refresh mode which does not require a high speed operation, a power supply voltage $V_{CC}$ is reduced from 3.3V to 2.0V, for example. When large fluctuation of such a power supply voltage, which is called a voltage bump, occurs, the substrate bias voltage is also reduced. In the above-described first prior art substrate bias voltage controlling apparatus, however, since means for raising the substrate bias voltage is not provided, the junction leakage current is increased, thus deteriorating the hold characteristics of memory cells. Note that the lower substrate bias voltage can be compensated for by refresh operations; however, it requires a long time.

In order to promptly raise the substrate bias voltage, a second prior art substrate bias voltage controlling apparatus includes a current leakage path within the bias voltage comparator circuit. This current leakage path leads from a power supply terminal for the power supply voltage to a substrate to which the substrate bias voltage is applied (see: JP-A-63-4491). This will also be explained later in detail.

In the second prior art substrate bias voltage controlling apparatus, however, a current always flows through the current leakage path regardless of the substrate bias voltage being low or high, thus increasing the power dissipation.

SUMMARY OF THE INVENTION

It is an object of the present invention to provide a substrate bias voltage controlling apparatus capable of bringing a substrate bias voltage close to a reference voltage when the substrate bias voltage is higher than the reference voltage and when the substrate bias voltage is lower than the reference voltage.

Another object of the present invention is to provide a step-up voltage controlling apparatus capable of bringing a step-up voltage close to a reference voltage when the step-up voltage is higher than the reference voltage and when the step-up voltage is lower than the reference voltage.

According to the present invention, in a bias voltage controlling apparatus, a bias voltage comparator circuit compares a bias voltage with a reference voltage. When the bias voltage is higher than the reference voltage, a bias voltage lowering circuit lowers the bias voltage. When the bias voltage is not higher than the reference voltage, a bias voltage lowering circuit raises the bias voltage. Thus, the bias voltage is brought close to the reference voltage by complete feedback control.

BRIEF DESCRIPTION OF THE DRAWINGS

The present invention will be more clearly understood from the description as set forth below, as compared with the prior art, with reference to the accompanying drawings, wherein.

DESCRIPTION OF THE PREFERRED EMBODIMENTS

Before the description of the preferred embodiments, prior art bias voltage controlling apparatuses will be explained with reference to FIGS. 1A, 1B, 2, 3, 4 and 5.

Figure 1A:
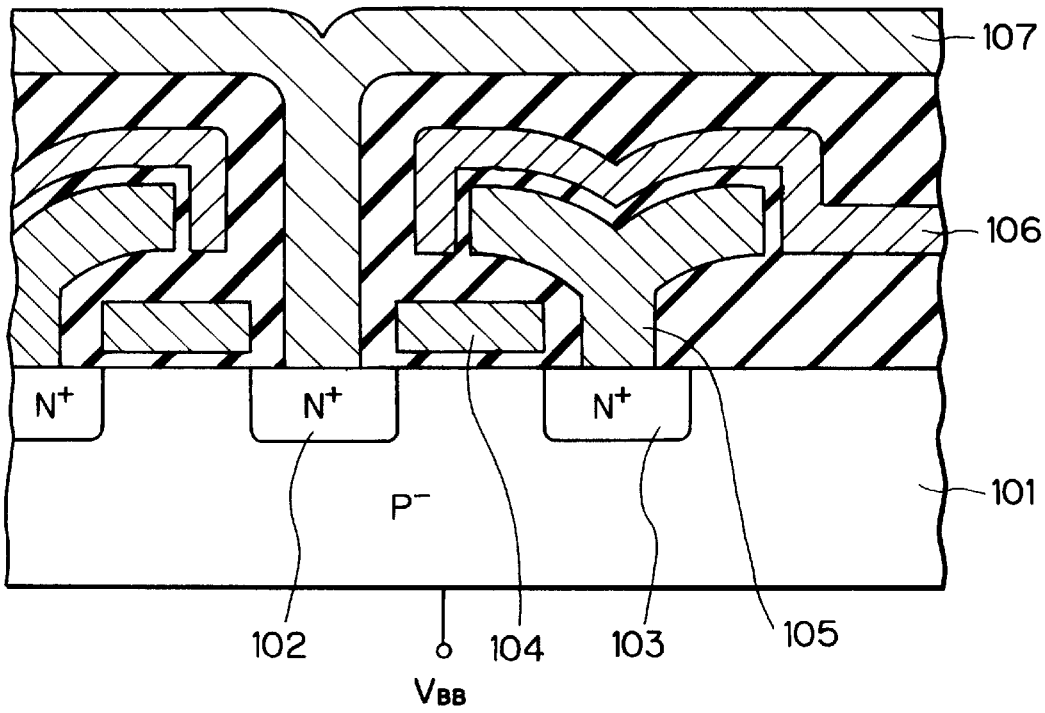
Fig. 1A PRIOR ART
FIG. 1A is a cross-sectional view illustrating a conventional DRAM cell.

In FIG. 1A, which illustrates a conventional stacked-capacitor type DRAM cell, reference numeral 101 designates a $P^-$type monocrystalline silicon substrate in which $N^+$-type impurity regions 102 and 103 are formed. Also, a first polycrystalline silicon layer 104 serving as a word line, a second polycrystalline silicon layer 105 connected to the $N^+$-type impurity regions 103, and a third polycrystalline silicon layer 106 serving as a cell plate are provided. Further, an aluminum layer 107 serving as a bit line is provided and is connected to the $N^+$-type impurity region 102. The polycrystalline silicon layers 104, 105 and 106 and the aluminum layer 107 are electrically isolated by insulating layers therebetween. Usually, the voltage at the polycrystalline silicon layer (cell plate) 106 is made $V_{CC}/2$ to alleviate an electric field within the insulating layer between the polycrystalline silicon layers 105 and 106. Also, the voltage at the aluminum layer (bit line) 107 is $V_{CC}/2$ during most of time. A substrate bias voltage $V_{BB}$ is applied by a substrate bias voltage controlling apparatus to the substrate 101.

Figure 1B:
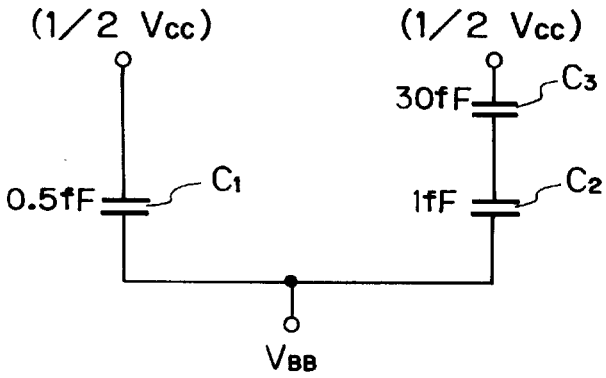
Fig. 1B PRIOR ART
FIG. 1B is an equivalent circuit diagram of the DRAM cell of FIG. 1.

As shown in FIG. 1B, a junction capacitance $C_1$ between the $N^+$-type impurity regions 102 and the substrate 101 is about 0.5 fF, and a junction capacitance $C_2$ between the $N^+$-type impurity regions 103 and the substrate 101 is about 1 fF. Also, a capacitance $C_3$ between the polycrystalline silicon layers 105 and 106 is about 30 fF. A capacitance $C_0$ per one cell is $$C_0 = C_1 + C_2 \cdot C_3/(C_2 + C_3) \approx 1.5\,fF$$

Therefore, if the DRAM device is of a 64 Mbit-type, a total capacitance is $$1.5\times64\times10^6\approx100\text{ nF}$$

Note that a peripheral circuit also has a capacitance; however, such a capacitance can be neglible as compared with the memory cell portion.

In the DRAM cell of FIG. 1A, data is held by storing charges in the capacitance between the polycrystalline silicon layers 105 and 106. However, the charges are leaked through a sub threshold leakage current flowing through the cell transistor formed by the elements 101 through 104 and a junction leakage current flowing through a PN junction between the $N^+$-type impurity regions 103 and the substrate 101 due to the lattice defect. Therefore, in order to improve the hold characteristics, the sub threshold leakage current and the junction leakage current are as small as pollible.

Figure 2:
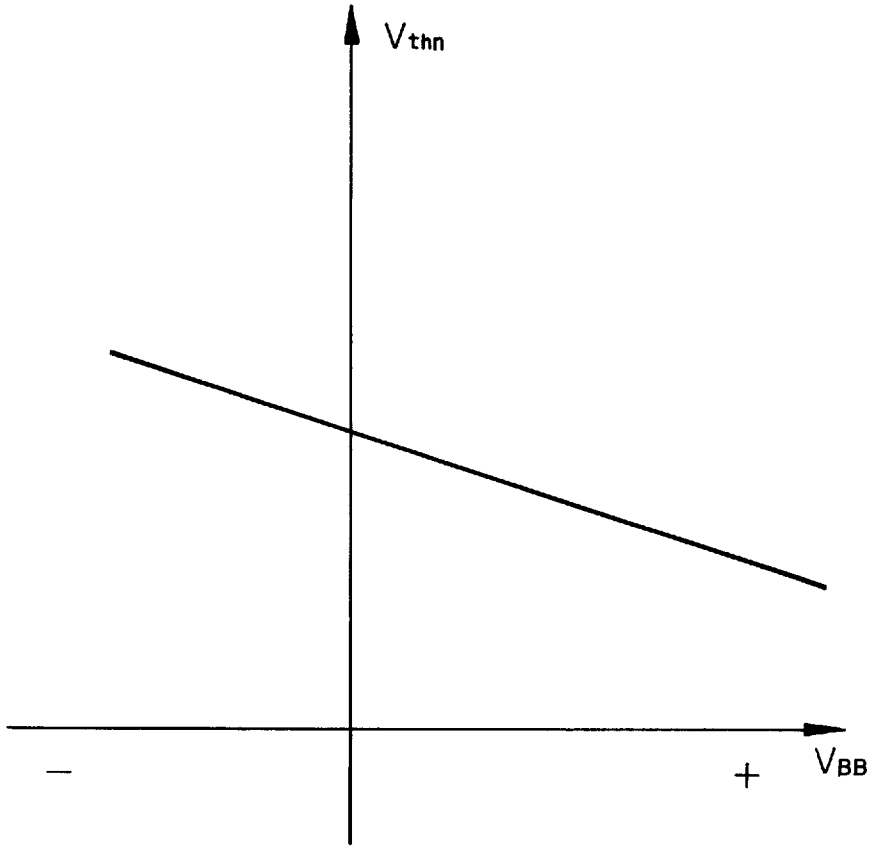
Fig. 2 PRIOR ART
FIG. 2 is a graph showing the substrate bias voltage to threshold voltage characteristics of the DRAM cell of FIG. 1A.

The sub threshold leakage current and the junction leakage current are dependent upon the substrate bias voltage $V_{BB}$. That is, as shown in FIG. 2, the higher the substrate bias voltage $V_{BB}$, the lower the threshold voltage $V_{thn}$. Therefore, when the substrate bias voltage $V_{BB}$ is made high, the sub threshold leakage current is increased to deteriorate the hold characteristics. On the contrary, the lower the substrate bias voltage $V_{BB}$, the higher the threshold voltage $V_{thn}$. Therefore, when the substrate bias voltage $V_{BB}$ is made low, the junction leakage current is also increased to deteriorate the hold characteristics. In view of this, there is an optimum value in the substrate bias voltage $V_{BB}$.

Figure 3:
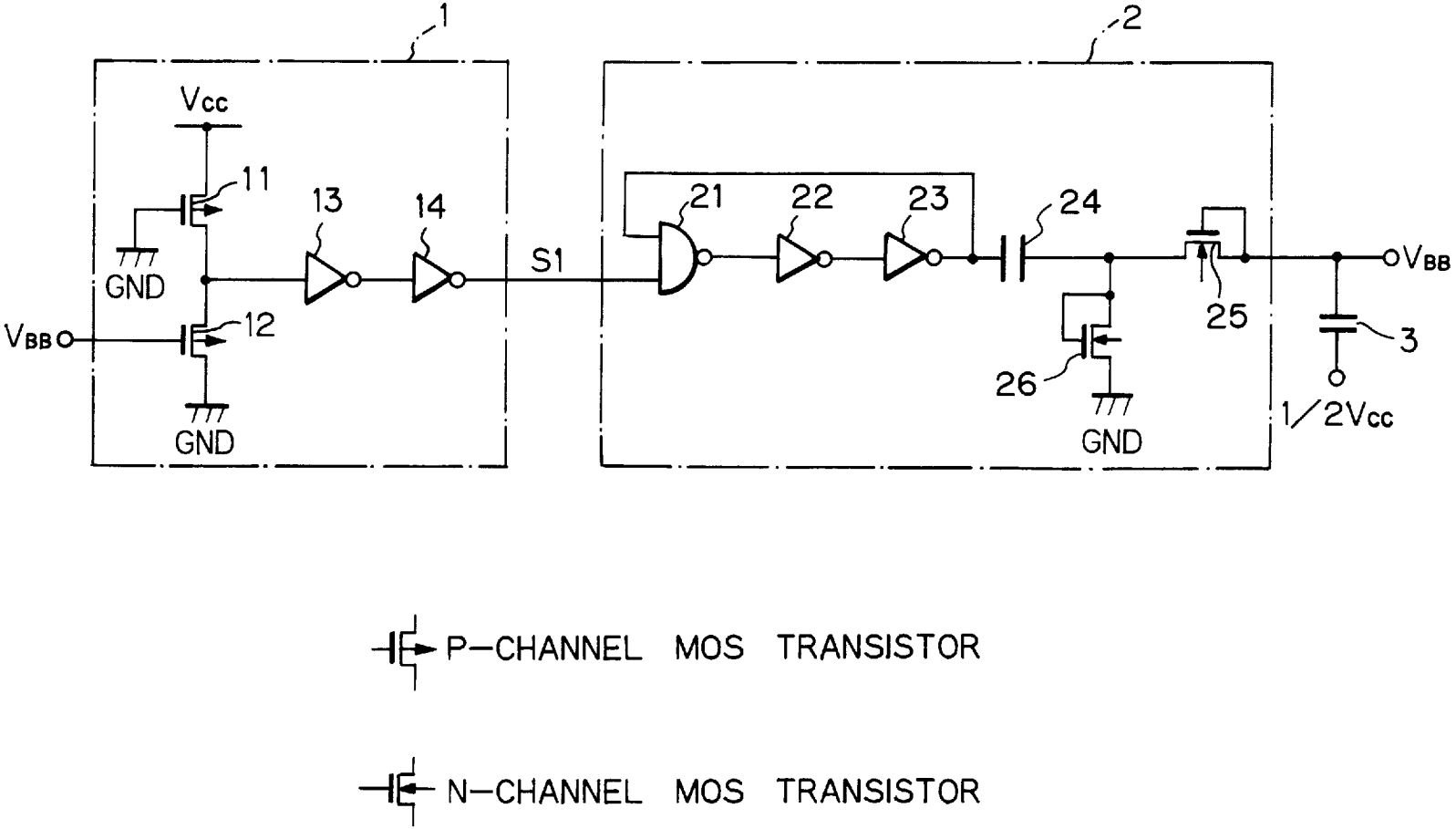
Fig. 3 PRIOR ART
FIG. 3 is a circuit diagram illustrating a first prior art bias voltage controlling apparatus.

In FIG. 3, which illustrates a first prior art substrate bias voltage controlling apparatus, reference numeral 1 designates a substrate bias voltage comparator circuit, and 2 designates a substrate voltage lowering circuit. Also, reference numeral 3 designates a capacitor formed in a DRAM device with respect to a semiconductor substrate. For example, the capacitance of the capacitor 3 is about 100 nF.

The substrate bias voltage comparator circuit 1 includes P-channel MOS transistors 11 and 12 arranged in series between a power supply voltage terminal $V_{CC}$ and a ground voltage terminal GND. Also, the substrate bias voltage comparator circuit 1 includes two inverters 13 and 14. In this case, the gate of the P-channel transistor 11 is grounded, and accordingly, the P-channel transistor 11 serves as a resistance element. Also, the gate of the P-channel transistor 12 receives the substrate bias voltage $V_{BB}$. Therefore, the substrate bias voltage comparator circuit 1 compares the substrate bias voltage $V_{BB}$ with a reference voltage $V_{BBR}$ which is determined by $$V_{BBR}=V_{CC}-V_{11}-|V_{thp}|$$

where $V_{11}$ is a voltage drop of the ON-state transistor 11; and $V_{thp}$ is a threshold voltage of the transistor 12.

When $V_{BB}>V_{BBR}$, the output signal S1 of the substrate bias voltage comparator circuit 1 is high, thus enabling the substrate bias voltage lowering circuit 2. Conversely, when $V_{BB}\leqq V_{BBR}$, the output signal S1 of the substrate bias voltage comparator circuit 1 is low, thus disabling the substrate bias voltage lowering circuit 2.

The substrate bias voltage lowering circuit 2 includes a NAND circuit 21 and two inverters 22 and 23 to form a ring oscillator. Also, the substrate bias voltage lowering cirucit 2 includes a capacitor 24, a drain-gate connected N-channel MOS transistor 25 serving as a diode, and a drain-gate connected N-channel MOS transistor 26 serving as a diode. The transistors 25 and 26 are connected in series between the substrate and the ground voltage terminal GND. Therefore, when the output signal S1 of the substrate bias voltage comparator circuit 1 is high, the ring oscillator (21, 22, 23) is activated, so that a current flows through a path of the transistors 25 and 26 from the substrate ($V_{BB}$) to the ground voltage terminal GND. Thus, the substrate bias voltage $V_{BB}$ is decreased. Conversely, when the output signal S1 of the substrate bias voltage comparator circuit 1 is low, the ring oscillator (21, 22, 23) is deactivated, so that a current does not flow through a path of the transistors 25 and 26. Thus, the substrate bias voltage $V_{BB}$ is maintained.

Recently, in a DRAM device mounted in a portable personal computer, the reduction of power dissipation is indispensible. Particularly, since a refresh mode time is relatively long, the reduction of power dissipation during the refresh mode is required. One approach is to lengthen a period between the refresh mode operations; however, in this case, improved hold characteristics of the memory cells must be strictly required. Another approach is to decrease the power supply voltage $V_{CC}$. For example, in an access mode, the power supply voltage $V_{CC}$ is made 3.3V to increase the operation speed, while in a refresh mode, the power supply voltage $V_{CC}$ is made 2.0V to decrease the operation speed.

Figure 4:
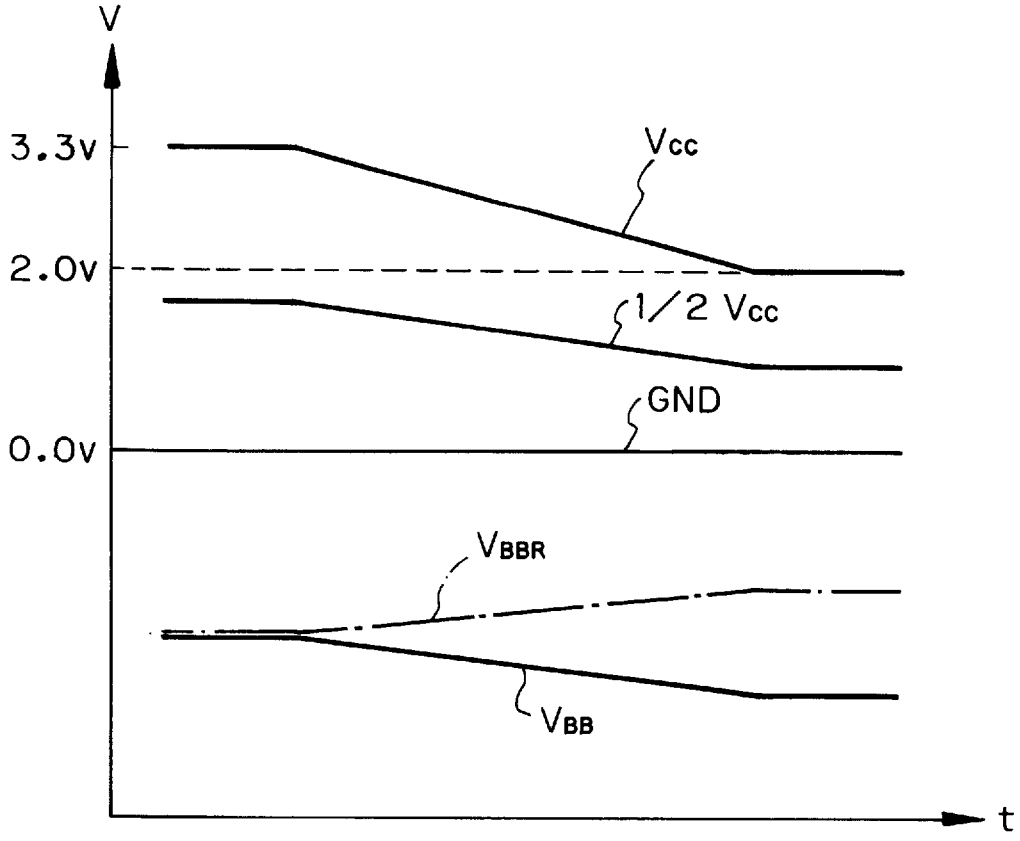
Fig. 4 PRIOR ART
FIG. 4 is a timing diagram for explaining the operation of the apparatus of FIG. 3.

In the substrate bias voltage controlling apparatus of FIG. 3, when the above-mentioned voltage bump occurs, the substrate bias voltage $V_{BB}$ may be remarkably decreased as compared with the reference voltage $V_{BBR}$. That is, as shown in FIG. 4, when the power supply voltage $V_{CC}$ is decreased from 3.3V to 2.0V, the voltage $V_{CC}/2$ follows the power supply voltage $V_{CC}$. Simultaneously, the substrate bias voltage $V_{BB}$ follows the voltage $V_{CC}/2$ due to the capacitive coupling. On the other hand, since a current flowing through the transistor 11 is reduced, so that the voltage drop $V_{11}$ is reduced, the reference voltage $V_{BBR}$ is increased. Therefore, the substrate bias voltage $V_{BB}$ is remarkably lower than the reference voltage $V_{BBR}$. As a result, the junction leakage current is increased to deteriorate the hold characteristics of the memory cells, and also, the threshold voltage is raised, so that the operation speed is fluctuated, thus inviting a skew in the operation, i.e., an erroneous operation. This cannot be compensated for, since no means for raising the substrate bias voltage $V_{BB}$ is provided.

Note that the substrate bias voltage $V_{BB}$ may be raised by refresh operations which supply a current to the substrate. However, since the parasitic capacitance relating the substrate bias voltage $V_{BB}$ is very large, a large number of refresh operations are needed to raise the substrate bias voltage $V_{BB}$, which is disadvantageous in respect to the power dissipation.

Also, note that a voltage bump such as 0.6V may occur in a usual operation.

Figure 5:
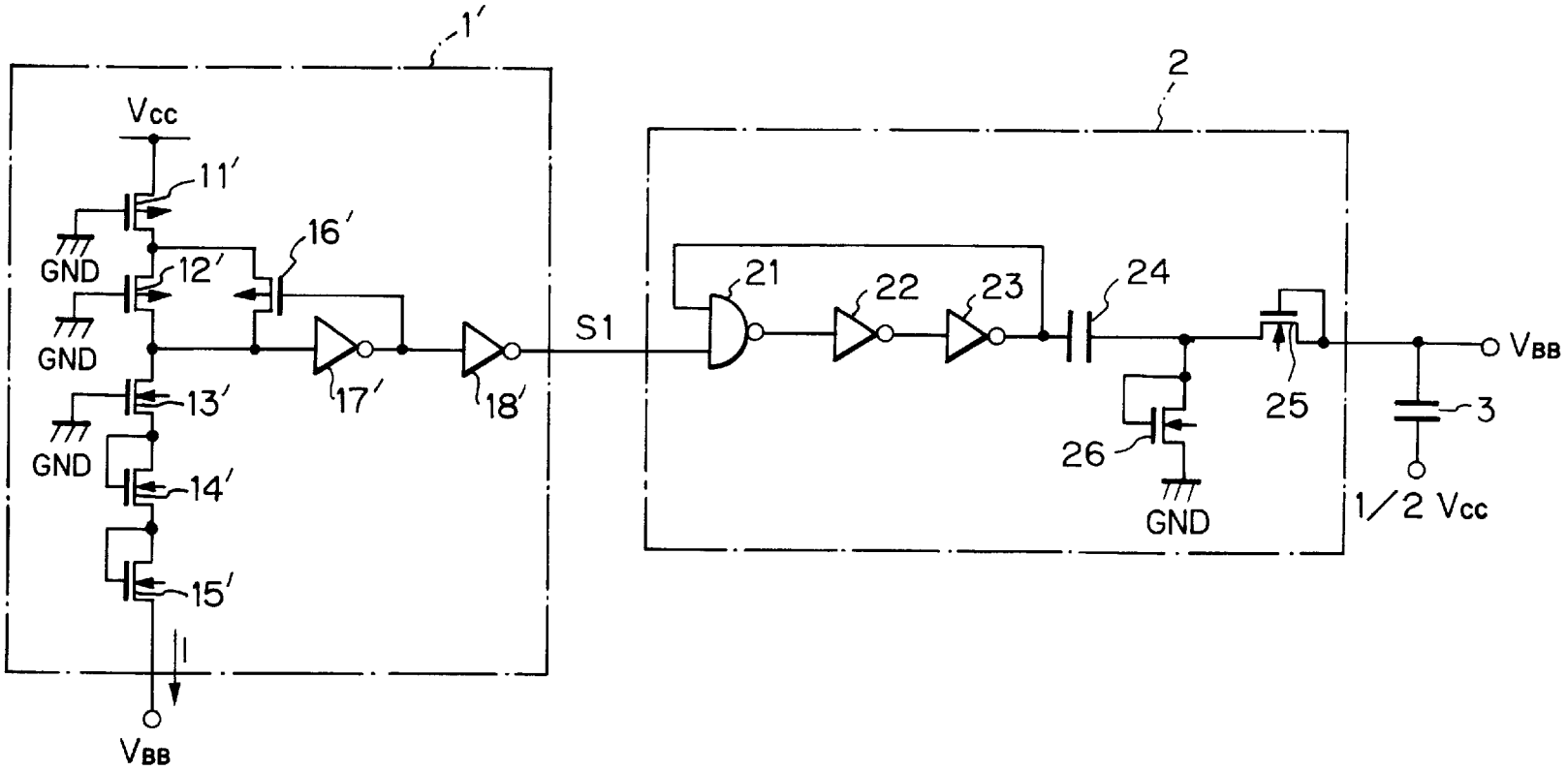
Fig. 5 PRIOR ART
FIG. 5 is a circuit diagram illustrating a second prior art bias voltage controlling apparatus.

In FIG. 5, which illustrates a second prior art substrate bias voltage controlling apparatus (see: JP-A63-4491), a substrate bias voltage comparator circuit 1' includes P-channel MOS transistors 11' and 12' and N-channel MOS transistors 13', 14' and 15' between the power supply terminal $V_{CC}$ and the substrate to which the substrate bias voltage $V_{BB}$ is applied. In this case, since the gates of the transistors 11', 12' and 13' are grounded, the transistors 11', 12' and 13' serves as resistances. Also, the transistors 14' and 15' serve as diodes. Also, the substrate bias voltage comparator circuit 1' includes a P-channel MOS transistor 16' connected in parallel to the transistor 12' and inverters 17' and 18', thus providing a hysteresis characteristic.

The operation of the substrate bias voltage comparator circuit 1' of FIG. 5 is basically the same as that of the substrate bias voltage comparator circuit 1 of FIG. 3 except that a current leakage path between the power supply terminal $V_{CC}$ and the substrate is provided to raise the substrate bias voltage $V_{BB}$.

In the substrate bias voltage controlling apparatus of FIG. 5, however, a large current of such as 100 $\mu$A always flows through the current leakage path regardless of the substrate bias voltage $V_{BB}$. This increases the power dissipation.

Figure 6:
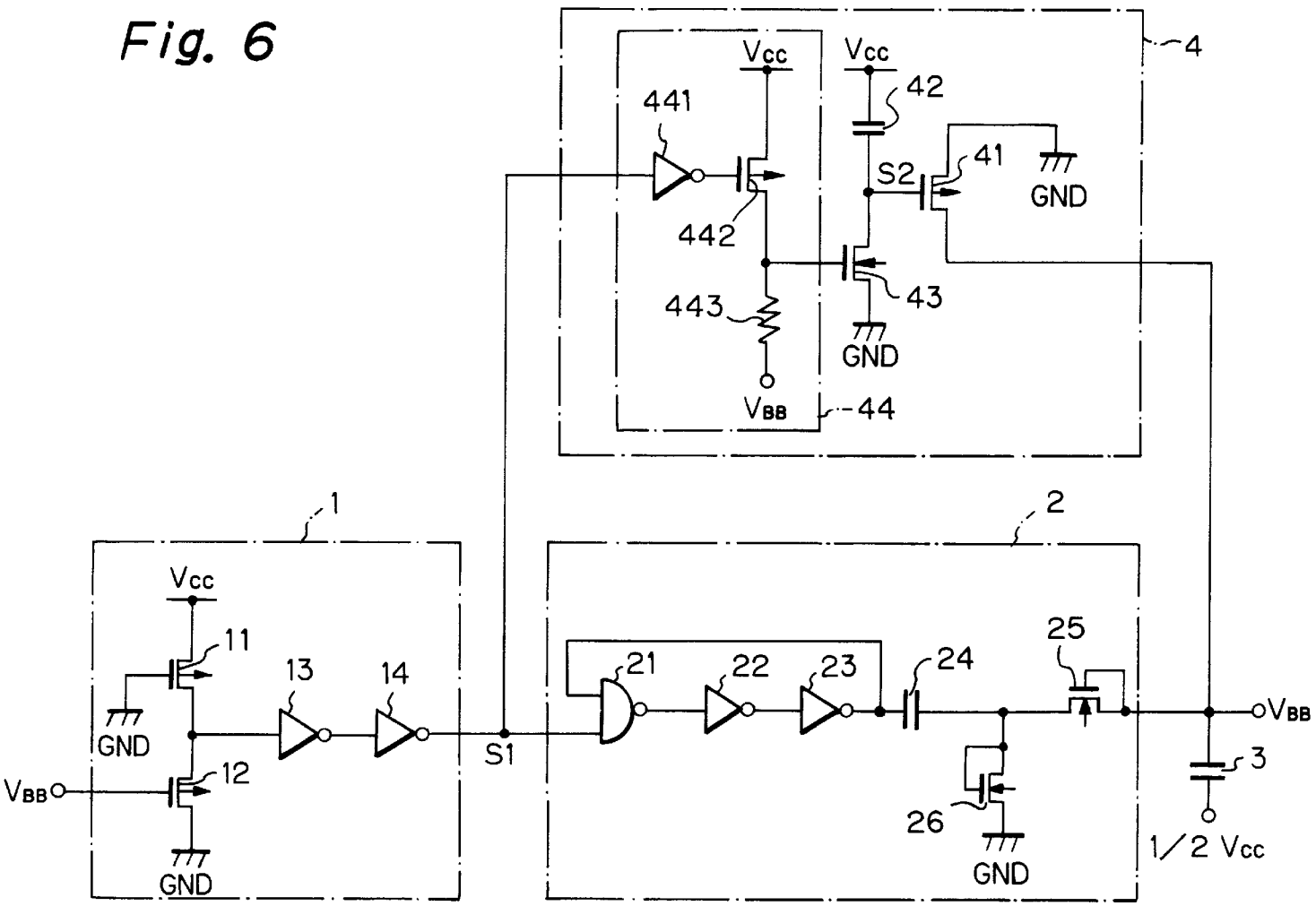
FIG. 6 is a circuit diagram illustrating a first embodiment of the bias voltage controlling apparatus according to the present invention.

In FIG. 6, which illustrates a first embodiment of the present invention, a substrate bias voltage raising circuit 4 is added to the elements of FIG. 3. The substrate bias voltage raising circuit 4 includes a P-channel enhancement-type MOS transistor 41 between the ground voltage terminal GND and the substrate, a capacitor 42 between the power supply terminal $V_{CC}$ and the gate of the transistor 41, and an N-channel enhancement-type MOS transistor 43 between the gate of the transistor 41 and the ground voltage terminal GND.

The transistor 41 is turned ON and OFF in accordance with a signal S2 at a node between the capacitor 42 and the transistor 43. In more detail, when $S2<-|V_{thp}|$ where $V_{thp}$ is a threshold voltage of the transistor 41, the transistor 41 is turned ON. Otherwise, the transistor 41 is turned OFF.

Also, the transistor 43 is turned ON and OFF in accordance with the output signal S1 of the substrate bias voltage comparator circuit 1 via a circuit 44. The circuit 44 is formed by an inverter 441, a P-channel MOS transistor 442 and a resistor 443. That is, when the output signal S1 of the substrate bias voltage comparator circuit 1 is low, the output signal of the inverter 441 is high to turn OFF the transistor 442. As a result, the gate voltage of the transistor 43 is $V_{BB}$, so that the transistor 43 is turned OFF. Conversely, when the output signal S1 of the substrate bias voltage comparator circuit 1 is high, the output signal of the inverter 441 is low to turn ON the transistor 442. As a result, the gate voltage of the transistor 43 is $V_{CC}$, so that the transistor 43 is turned ON.

Figure 7:
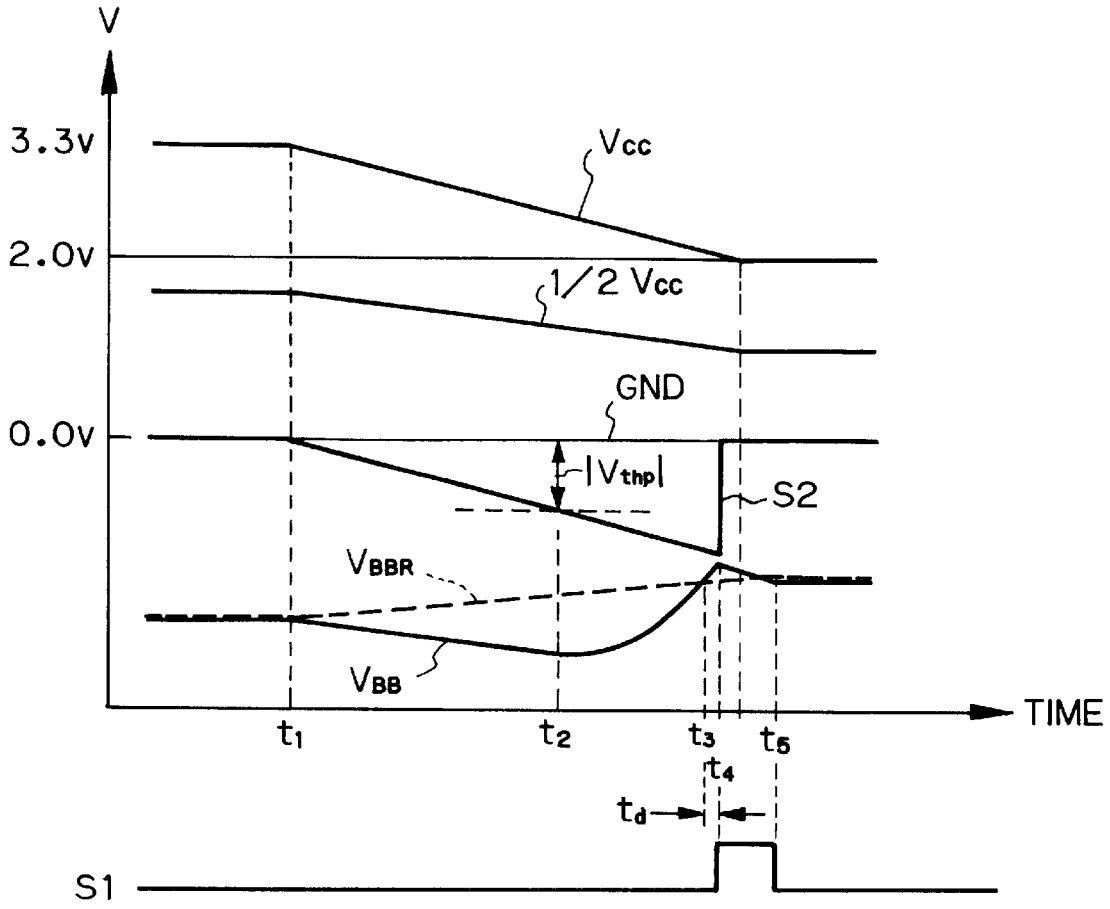
FIG. 7 is a timing diagram for explaining the operation of the apparatus of FIG. 6.

The operation of the substrate bias voltage controlling apparatus of FIG. 6 is explained next with reference to FIG. 7 where the power supply voltage $V_{CC}$ is decreased from 3.3V to 2.0V.

Before time t1, the substrate bias voltage $V_{BB}$ is at an optimum value. Therefore, the output signal S1 of the substrate bias voltage comparator circuit 1 is low. In this state, the transistor 43 is turned OFF, and the signal S2 is 0V.

At time t1, when the power supply volage $V_{CC}$ and the voltage $V_{CC}/2$ begin to decrease, the substrate bias voltage $V_{BB}$ also begin to decrease due to the capacitive coupling of the junction capacitance. Simultaneously, the voltage of the signal S2 begins to decrease due to the capacitive coupling of the capacitor 42, since the transistor 43 is turned OFF. In this state, the transistor 41 is still turned OFF.

At time t2, when the voltage of the signal S2 reaches $|V_{thp}|$, the transistor 41 is turned ON. As a result, a current flows from the ground voltage terminal GND to the substrate, and therefore, the substrate bias voltage $V_{BB}$ begins to increase. Note that the speed of the increase of the substrate bias voltage $V_{BB}$ is adjusted by the size of the transistor 41.

At time t3, when the substrate bias voltage $V_{BB}$ reaches the reference voltage $V_{BBR}$, the output signal S1 of the substrate bias voltage comparator circuit 1 is changed from low to high at time t4 with a delay time td. Therefore, the transistor 43 is turned ON, so that the voltage of the signal S2 becomes 0V, to turn OFF the transistor 41.

Thus, after time t4, the substrate bias voltage lowering circuit 2 is operated instead of the substrate bias voltage raising circuit 4. Finally, at time t5, the substrate bias voltage $V_{BB}$ is converged to the reference voltage $V_{BBR}$.

Thus, even when the power supply voltage $V_{CC}$ is changed from 3.3V to 2.0V, the substrate bias voltage $V_{BB}$ is promptly brought close to the reference voltage $V_{BBR}$ due to the complete feedback control.

The present invention is applied to a step-up voltage controlling apparatus. Generally, in a DRAM device, a bias voltage higher than the power supply voltage $V_{CC}$ is required to drive word lines. This high bias voltage is called a step-up voltage of a bootstrapped voltage $V_{BOOST}$. For controlling the step-up voltage $V_{BOOST}$, a step-up voltage controlling apparatus is incorporated in the DRAM device. The same problem of the substrate bias voltage $V_{BB}$ occurs in the step-up voltage $V_{BOOST}$. That is, when the step-up voltage $V_{BOOST}$ is too high, noise applied to the word ines is increased to deteriorate the hold characteristics of the memory cells. Also, the operation speed is fluctuated to invite a skew in the operation, i.e., an erroneous operation. Therefore, in a step-up controlling apparatus, the prompt control of bringing the step-up voltage $V_{BOOST}$ to a reference voltage is indispensible.

Figure 8:
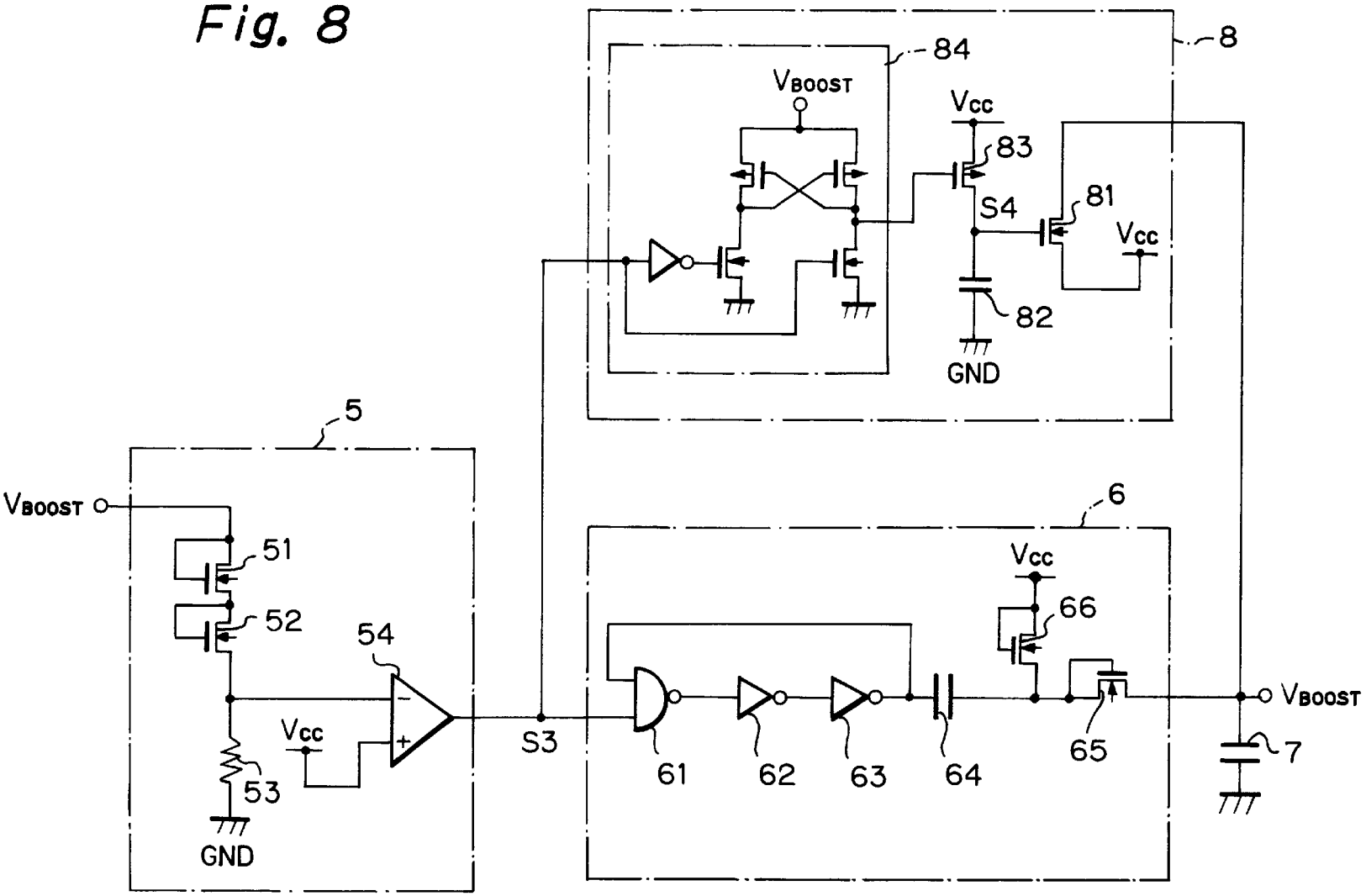
FIG. 8 is a circuit diagram illustrating a second embodiment of the bias voltage controlling apparatus according to the present invention.

In FIG. 8, which illustrates a second embodiment of the present invention, a step-up voltage controlling apparatus is illustrated. In FIG. 8, reference numeral 5 designates a step-up voltage comparator circuit, and 6 designates a step-up voltage raising circuit. Also, reference numeral 7 designates a capacitor formed in a DRAM device with respect to the step-up voltage $V_{BOOST}$. Further, reference numeral 8 designates a step-up voltage lowering circuit.

The step-up voltage comparator circuit 5 includes N-channel MOS transistors 51 and 52 and a resistor 53 arranged in series between a portion to which the step-up voltage $V_{BOOST}$ is applied and the ground voltage terminal GND. The drains of the transistors 51 and 52 are connected to the gates thereof, and accordingly, the transistors 51 and 52 serve as resistances. Therefore, the elements 51, 52 and 53 serve as a voltage divider for the step-up voltage $V_{BOOST}$. Also, the step-up voltage comparator circuit 5 includes a voltage comparator 54 for comparing the step-up voltage $V_{BOOST}\cdot\alpha$ with $V_{CC}$. In this case, a coefficient $\alpha$ is determined by $$\alpha=R_3/(R_1+R_2+R_3)$$

where $R_1$, $R_2$ and $R_3$ are resistance values of the transistors 51, 52 and the resistor 53, respectively. Therefore, the step-up voltage comparator circuit 5 compares the step-up voltage $V_{BOOST}$ with a reference voltage $V_{BOOSTR}$ ($=V_{CC}/\alpha$).

When $V_{BOOST}<V_{BOOSTR}$, the output signal S3 of the step-up voltage comparator circuit 5 is high, thus enabling the step-up voltage raising circuit 6 and disabling the step-up voltage lowering circuit 8. Conversely, when $V_{BOOST}$24 $V_{BOOSTR}$, the output signal S3 of the step-up voltage comparator circuit 5 is low, thus enabling the step-up voltage lowering circuit 8 and disabling the step-up voltage raising circuit 6.

The step-up voltage raising circuit 6 includes a NAND circuit 61 and two inverters 62 and 63 to form a ring oscillator. Also, the step-up voltage raising cirucit 6 includes a capacitor 64, a drain-gate connected N-channel MOS transistor 65 serving as a diode, and a drain-gate connected N-channel MOS transistor 26 serving as a diode. The transistors 65 and 66 are connected in series between the power supply terminal $V_{CC}$ and the portion ($V_{BOOST}$). Therefore, when the output signal S3 of the step-up voltage comparator circuit 5 is high, the ring oscillator (61, 62, 63) is activated, so that a current flows through a path of the transistors 65 and 66 from the power supply terminal $V_{CC}$ to the portion ($V_{BOOST}$). Thus, the step-up voltage $V_{BOOST}$ is increased. Conversely, when the output signal S3 of the step-up voltage comparator circuit 6 is low, the ring oscillator (61, 62, 63) is deactivated, so that a current does not flow through a path of the transistors 65 and 66.

The step-up voltage lowering circuit 8 includes an N-channel enhancement-type MOS transistor 81 between the power supply voltage terminal $V_{CC}$ and the portion ($V_{BOOST}$), a capacitor 82 between the gound voltage terminal GND and the gate of the transistor 81, and a P-channel enhancement-type MOS transistor 83 between the gate of the transistor 81 and the power supply terminal $V_{CC}$.

The transistor 41 is turned ON and OFF is accordance with a signal S4 at a node between the capacitor 82 and the transistor 83. In more detail, when S4>$V_{thn}$ where $V_{thn}$ is a threshold voltage of the transistor 81, the transistor 81 is turned ON. Otherwise, the transistor 81 is turned OFF.

Also, the transistor 83 is turned ON and OFF in accordance with the output signal S3 of the step-up voltage comparator circuit 5 via a circuit 84 which is formed by a flip-flop. That is, when the output signal S3 of the step-up voltage comparator circuit 5 is low, the output of the circuit 84 is high. As a result, the gate voltage of the transistor 83 is $V_{BOOST}$, so that the transistor 83 is turned OFF. Conversely, when the output signal S3 of the step-up voltage comparator circuit 5 is high, the output of the circuit 84 is low. As a result, the gate voltage of the transistor 83 is 0V, so that the transistor 83 is turned ON.

Figure 9:
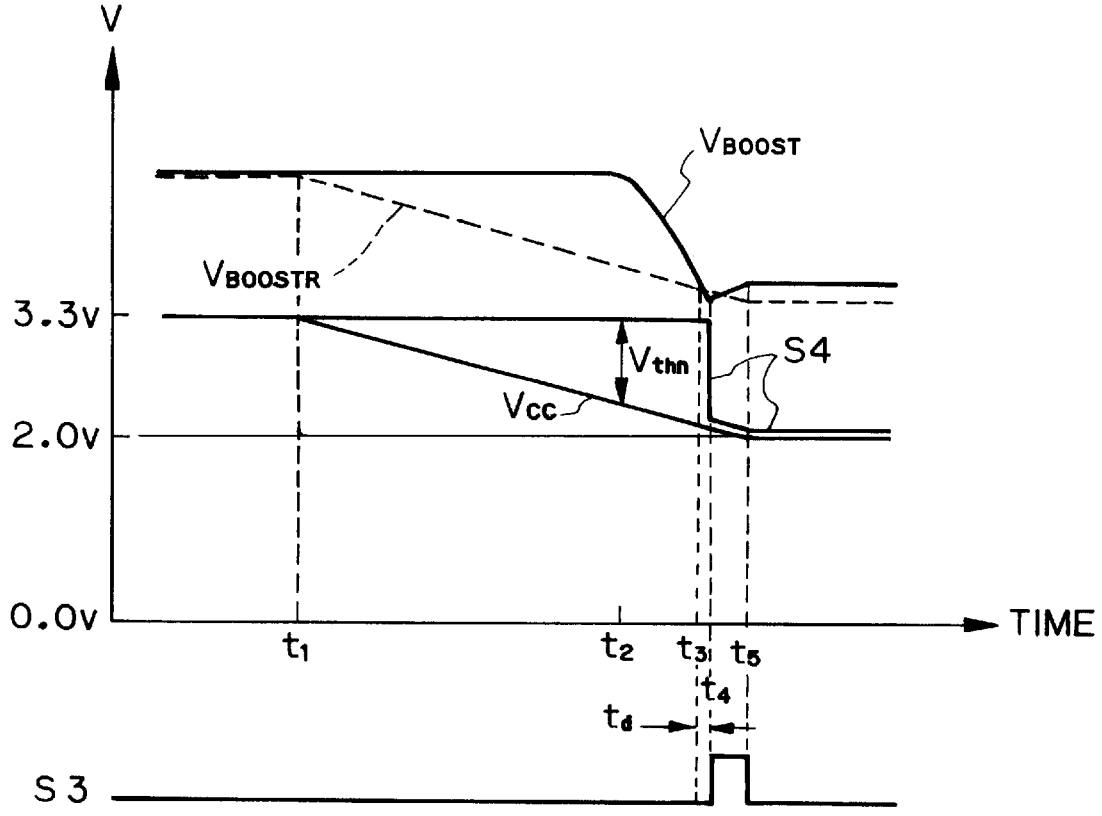
FIG. 9 is a timing diagram for explaining the operation of the apparatus of FIG. 8.

The operation of the stip-up voltage controlling apparatus of FIG. 8 is explained next with reference to FIG. 9 where the power supply voltage $V_{CC}$ is decreased from 3.3V to 2.0V.

Before time t1, the step- up voltage $V_{BOOST}$ is at an optimum value. Therefore, the output signal S3 of the step-up voltage comparator circuit 5 is low. In this state, since the transistor 83 is turned OFF, and the signal S4 is 3.3V.

At time t1, when the power supply voltage $V_{CC}$ begins to decrease, the reference voltage $V_{BOOSTR}$ also begin to decrease due to the relationship $V_{BOOSTR}=V_{CC}/\alpha$. In this case, since the transistor 83 is turned OFF, the voltage of the signal S4 is maintained. Also, the step-up voltage $V_{BOOST}$ is maintained. In this state, the transistor 81 is still turned OFF.

At time t2, when the power supply voltage $V_{CC}$ reaches $3.3-V_{thn}$, the transistor 81 is turned ON. As a result, a current flows from the portion ($V_{BOOST}$) to the power supply terminal $V_{CC}$, and therefore, the step-up voltage $V_{BOOST}$ begins to decrease. Note that the speed of the decrease of the step-up voltage $V_{BOOST}$ is adjusted by the size of the transistor 81.

At time t3, when the step-up voltage $V_{BOOST}$ reaches the reference voltage $V_{BOOSTR}$, the output signal S3 of the step-up voltage comparator circuit 6 is changed from low to high at time t4 with a delay time td. Therefore, the transistor 83 is turned ON, so that the voltage of the signal S4 becomes $V_{CC}$, to turn OFF the transistor 81.

Thus, after time t4, the step-up voltage raising circuit 6 is operated instead of the step-up voltage lowering circuit 8. Finally, at time t5, the step-up voltage $V_{BOOST}$ is converged to the reference voltage $V_{BOOSTR}$.

Thus, even when the power supply voltage $V_{CC}$ is changed from 3.3V to 2.0V, the step-up voltage $V_{BOOST}$ is promptly brought close to the reference voltage $V_{BOOSTR}$ due to the complete feedback control.

As explained hereinbefore, according to the present invention, even when the power supply voltage is fluctuated, a bias voltage such as a substrate bias voltage or a step-up voltage can be promptly converged to its reference voltage.

I claim:

1. A bias voltage controlling apparatus comprising:

a first power supply voltage means for receiving a first power supply voltage;

a second power supply voltage means for receiving a second power supply voltage lower than said first power supply voltage;

a bias voltage means for receiving a bias voltage lower than said second power supply voltage;

a single bias voltage comparator circuit, connected to said bias voltage means, for comparing said bias voltage with a single reference voltage;

a bias voltage lowering circuit, connected to said first power supply voltage means, and also connected between said bias voltage comparator circuit and said bias voltage means, for lowering said bias voltage when said bias voltage is higher than said reference voltage; and a bias voltage raising circuit, connected to said first and second power supply means, and also connected between said bias voltage comparator circuit and said bias voltage means, for raising said bias voltage when said bias voltage is not higher than said reference voltage; wherein said bias voltage lowering circuit includes a charge pump circuit;

said bias voltage raising circuit includes:

a first switching element connected between said second power supply voltage means and said bias voltage means, a capacitor connected between said first power supply voltage means and a control terminal of said first switching element, and a second switching element connected between the control terminal of said first switching element and said second power supply voltage means;

said second switching element being turned ON when said bias voltage comparator circuit indicates that said bias voltage is higher than said reference voltage, and said second switching element being turned OFF when said bias voltage comparator circuit indicates that said bias voltage is not higher than said reference voltage;

said bias voltage comparator circuit includes:

a resistance means connected to said first power supply voltage means, and a P-channel enhancement-type MOS transistor connected between said resistance means and said second power supply voltage means, a gate of said P-channel enhancement-type MOS transistor being connected to said bias voltage means.

2. The apparatus as set forth in claim 1, wherein said first switching element comprises a P-channel enhancement type MOS transistor.

3. The apparatus as set forth in claim 1, wherein said second switching element comprises an N-channel enhancement type MOS transistor.

4. A bias voltage controlling apparatus comprising:

a first power supply voltage means for receiving a first power supply voltage;

a second power supply voltage means for receiving a second power supply voltage lower than said first power supply voltage;

a bias voltage means for receiving a bias voltage higher than said first power supply voltage;

a single bias voltage comparator circuit, connected to said bias voltage means, for comparing said bias voltage with a single reference voltage;

a bias voltage raising circuit, connected to said first power supply voltage means, and also connected between said bias voltage comparator circuit and said bias voltage means, for raising said bias voltage when said bias voltage is lower than said reference voltage; and a bias voltage lowering circuit, connected to said first and second power supply voltage means, and also connected between said bias voltage comparator circuit and said bias voltage means, for lowering said bias voltage when said bias voltage is not lower than said reference voltage; wherein said bias voltage raising circuit includes a charge pump circuit;

said bias voltage lowering circuit includes:

a first switching element connected between said first power supplv voltage means and said bias voltage means, a capacitor connected between said second power supply voltage means and a control terminal of said first switching element, and a second switching element connected between the control terminal of said first switching element and said first power supply voltage means;

said second switching element being turned ON when said bias voltage comparator circuit indicates that said bias voltage is lower than said reference voltage, and said second switching element being turned OFF when said bias voltage comparator circuit indicates that said bias voltage is not lower than said reference voltage;

said bias voltage comparator circuit includes:

a voltage divider connected between said bias voltage means and said second power supply voltage means, and a voltage comparator connected to said voltage divider and said first power supply voltage means, for comparing an output voltage of said voltage divider with said first power supply voltage.

5. The apparatus as set forth in claim 4, wherein said first switching element comprises an N-channel enhancement type MOS transistor.

6. The apparatus as set forth in claim 4, wherein said second switching element comprises a P-channel enhancement type MOS transistor.

* * * * *